US005261134A

United States Patent [19]

Matthews

[11] Patent Number: 5,261,134

[45] Date of Patent: Nov. 16, 1993

[54] INFANT SUPPORT PILLOW

[76] Inventor: Susan H. Matthews, 26907 Cold Spring Gulch, Golden, Colo. 80409

[21] Appl. No.: 944,629

[22] Filed: Sep. 14, 1992

Related U.S. Application Data

[63] Continuation of Ser. No. 822,631, Jan. 17, 1992, abandoned, which is a continuation of Ser. No. 616,410, Nov. 21, 1990, abandoned.

[51] Int. Cl.[5] ..... A47C 10/00

[52] U.S. Cl. ..... 5/655; 5/652; 5/653; 5/630

[58] Field of Search ..... 5/630, 633, 652, 653, 5/655

[56] References Cited

U.S. PATENT DOCUMENTS

| | | | |
|---|---|---|---|
| 4,197,604 | 4/1980 | Nakamura | 5/640 |
| 4,236,264 | 12/1980 | Britzman | 5/640 |
| 4,731,890 | 3/1980 | Roberts | 5/636 X |

FOREIGN PATENT DOCUMENTS

| | | | |
|---|---|---|---|
| 2379268 | 9/1978 | France | 5/424 |
| 1508809 | 4/1970 | United Kingdom | 5/636 |

*Primary Examiner*—Michael F. Trettel

[57] ABSTRACT

A portable pillow for support of an infant, toddler or young child is disclosed. The upper and lower surfaces are rounded, resulting in a generally tubular shape, tapered at the ends and curved in an oval so that the tapered ends engage one another when the pillow is not in use. The pillow is generally concave with respect to a vertical axis of symmetry, and since the left and right sides are symmetrical, the infant body is provided with sufficient pressure and vertebral support that he or she is prevented from rolling over when placed in the center well of the device. The pillow also provides anatomically correct support along the vertebral column of a toddler or young child. This support is accomplished by firm, resilient padding and thus minimizes vertebral strain for all ages.

16 Claims, 2 Drawing Sheets

INFANT SUPPORT PILLOW

This is a continuation of copending application Ser. No. 07/822,631, filed on Jan. 17, 1992, which was a continuation of application Ser. No. 07/616,410, filed Nov. 21, 1990, both now abandoned.

BACKGROUND OF THE INVENTION

This invention relates generally to the design of therapeutic support pillows and more particularly to an infant support pillow proportioned to hold a small child or infant in a manner that prohibits lateral movement. It accomplishes this by its symmetric design and relatively equal height along the circumference of the support pillow. The vast majority of available pillow designs focus upon adult needs for support and concern the proper angle for the head and neck of an adult. The present invention features a pillow dimensioned for the support of an infant or small child. It is generally circular but discontinuous where tapered ends meet, defining a well in the center. When an infant's body is placed in this well, the head is supported by the central portion of the pillow and the feet extend out between the tapered ends so that the infant has an equivalent amount of firm padding on both left and right sides, thus preventing tilting to either side.

The underdeveloped bone structure of an infant and small child requires substantially more support than older children or adults. Given their underdeveloped musculature, infants are vulnerable to movements that place them off-balance from the midsagittal plane and cause them to tip over, thus requiring additional support.

Typical head support cushions for adults are dimensioned in height, width and depth to fit the head and neck of an adult. They also presuppose a degree of muscle control to hold them in place that is lacking in infants and small children. In each of these designs, the head rests above the top of the pillow and the neck is supported by a relatively stiff portion that runs along the back of the neck, concave about a vertical axis corresponding to the central vertebral axis of the neck. Each has a convex surface that conforms to the arch at the back of the neck. Specifically, U.S. Pat. No. 4,679,262 (Davis) discloses a toroidal segment, relatively stiff but pliable, which provides support in the form of an arch from the mastoid process, along the jaw of an adult or large child, to the chin. U.S. Pat. No. 4,285,081 (Price) discloses two versions of a head support device that contours around the neck, with free ends that apply gentle pressure upon the mastoid processes. U.S. Pat. No. 2,167,622 (Bentivoglio) is proportioned to support the head and neck, leaving the shoulders and hair free, as when curlers are worn.

A contoured pillow with a central aperture is disclosed in U.S. Pat. No. 4,788,728 (Lake). The body of the pillow is rectangular, with a curved depression centrally positioned so that the head above the temples is supported, as are the neck and chin, but the user's face is suspended above the depression and exerts no force upon the foam body of the pillow. The irregularly shaped depression is specifically contoured to avoid contact with the face.

The ornamental design of a horseshoe-shaped pillow is disclosed in U.S. Pat. No. Des. 124,296 (Thompson). It features flat outer and inner walls, as well as flat side walls, with no overlap of the free ends. There is no indication of size, composition or degree of support provided by this ornamental design.

A pillow designed for the support of infants and small children while asleep in a sitting position is disclosed in U.S. Pat. No. 4,726,085 (Antonio). It consists of a thin, U-shaped inset of foam rubber covered with fabric. It is placed about the head so that the neck fits into the U-shaped opening and the free ends extend down the chest of the infant, forming a shelf-like configuration about the shoulders. When the infant nods its head downward, forward, or to either side, the shelf of foam rubber supports the head from further movement. This device supports only the head, not any other portion of the infant's body.

An apertured article for use as an infant's head rest is disclosed in U.S. Pat. No. 3,848,281 (Mathews). This toroidal foam rubber cushion is covered in fabric and dimensioned so the ear of the infant will project into the aperture. The cover is made of a flat piece of fabric that lines the aperture and joins to side pieces to form a circle at each side. As a result, the cushion has a shape similar to an automobile tire.

Therefore, it is an object of the present invention to provide support for the entire body of an infant or the upper torso of a small child.

It is another object is to provide lateral support to prevent the infants or children from slipping sideways as they rest over the central portion of a horseshoe shaped support.

Another object is to provide support of the neck and head of an infant to avoid muscle strain.

A further object is to provide a comfortable cushion for an older child while sedentary, such as while watching TV or reading.

SUMMARY OF THE INVENTION

To achieve these and other objects, there is provided a device for supporting infants. The device includes a firm, resilient and structurally self-supporting cushion body, with a medial region and first and second opposed cantilever arms extended in opposite directions from the medial region. The cantilever arms have respective first and second end portions remote from the medial region. The cantilever arms are curved about a vertical axis to determine a substantially toroidal configuration for the cushion body, and also to position the first and second end portions in a confronting relation to one another. The arms and the medial region cooperate to define a generally circular open well, with the arms and medial region substantially surrounding the well. A nominal width of the well, taken perpendicular to a central plane that includes the vertical axis and passes through the medial region, is in the range of from about four to about eight inches. The first and second cantilever arms have respective first and second downwardly and radially inwardly inclined support surfaces running along and adjacent the open well. These support surfaces contact the infant when the cantilever arms and medial region support the infant substantially lengthwise along the central plane, with the head of the infant upon the medial region and the torso of the infant upon the cantilever arms and spanning the open well. The cantilever arms, through their respective support surfaces, tend to confine the infant against rolling in either direction away from the central plane.

Preferably, each of the arms and medial region has a substantially elliptical profile, when the profile is taken radially of the vertical axis. The cushion body preferably is symmetrical about the central plane, with the first and second arms being substantially identical to one another. The cushion body further can be symmetrical about a horizontal mid-plane. This provides a substantially toroidal cushion body with blunt ends preferably engaged with one another to completely enclose the well. These ends are readily separated from one another, however, through elastic deformation of the cantilever arms. Thus, the device provides a firm support pillow shaped like a rounded horseshoe, but "closed" (with the arm ends touching one another) when the pillow is not in use.

An infant may be placed upon the support pillow either in the prone or supine position. In either event, positioning is proper when the infant lies lengthwise along the central plane, with the head of the infant directly upon the medial region, and the torso of the infant directly upon the wall, supported by the cantilever arms by virtue of the infant's torso spanning the well. Depending upon the size of the infant, the region of the hips or legs likewise may be supported by the cantilever arms. Alternatively, the legs may be positioned between the arm end portions, thus elastically deforming the arms. In this event, the restoring force in the cantilever arms supplements the action of the support surfaces in confining the infant against slipping or rolling.

Certain features of the support pillow are particularly advantageous for supporting infants. For example, the pillow body is firm in the sense of undergoing only slight elastic deformation (as compared to a conventional pillow) when subjected to the weight of an infant's head and shoulders. This prevents an infant, particularly when in the prone position, from "sinking into" the pillow in the region about his or her face, thus to prevent any interference with the ability to breathe.

Secondly, the cushion body is self-supporting in the sense that when held (for example) by one hand along the medial region, the cushion body retains its shape, without any sagging or drooping of the cantilever arms. This degree of firmness or stiffness enables the cantilever arms to positively support the infant, nested upon the support surfaces and somewhat into the open well, thus to confine the infant against any sideways rolling.

Yet another advantage arises from the geometry of the cushion body, more particularly its generally toroidal configuration, in combination with the cantilever arm ends. When the infant is positioned properly on the pillow, the head is supported at the chin (prone position), or alternatively the head and nape of the neck are supported at the medial region (supine position), in either event for an elastically conforming but relatively firm manner of support. The arms elastically yield to provide the same type of support to the torso and hips of the infant, and further yield elastically in cantilever fashion to accommodate infants of different sizes, as well as somewhat different positions for the same infant, e.g. legs at rest upon engaged arm ends verses legs supported between separated arm ends.

The size of the open well is selected for optimum support of the infant, in general to assure that the well is at least half as wide as the span of the infant's torso, yet substantially less than the span, for example at most seven-eighths of this span. Accordingly, the width of the well is within the range of four to eight inches, with a width of six inches being especially preferred. Proper selection of this width ensures that the infant is properly confined against rolling, and also supported by the cantilever arms and medial region, rather than by the floor or other surface immediately beneath the support pillow.

A further advantage of the pillow geometry is that the infant, when properly positioned, is free to move his or her arms, since the arms and shoulders are supported above the well. This promotes play, feeding and other activities where movement of the hands and arms is either necessary or desirable.

The pillow has a central core of firm, hypoallergenic polyester and is covered in cotton fabric. Alternatively, the body can be formed of a foamed rubber or elastomer. In either event, a conforming cover of cotton or other fabric can be provided, and preferably is removable for laundering. According to the present invention, the pillow provides firm support for the weak musculature and underdeveloped bone structure of an infant in a variety of postural positions. It avoids muscle strain from nonphysiologic positions and provides full support for the neck and head. It also provides a comfortable cushion for toddlers and young children resting in a variety of positions.

IN THE DRAWINGS

For a further understanding of the above and other features and advantages, reference is made to the detailed description and to the drawings, in which.

FIG. 4A-E depict exemplary applications of the present invention as used by infants and older children.

DESCRIPTION OF THE PREFERRED EMBODIMENTS

Figure 1:
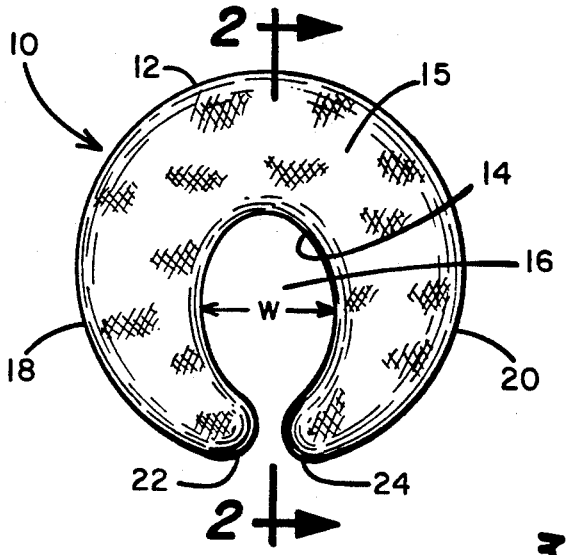
FIG. 1 is a top plan view of a support pillow constructed in accordance with the present invention.

A preferred embodiment of the infant support pillow or cushion as disclosed in the present invention is shown in FIG. 1. The support pillow, generally depicted as 10, has a generally toroidal shape. A curved outer surface 12 of the pillow is rounded in both a longitudinal and a lateral direction. The central, inner curve 14 defines a rounded, generally circular or elliptical well region 16. While the body of support pillow 10 is substantially continuous and uniform, with curves 12 and 14 also continuous, it nonetheless is convenient to consider the pillow body as consisting of a medial region 15, and two opposed cantilever arms 18 and 20. The arms extend in opposite directions away from the medial region, but are curved towards one another to give the pillow its toroidal configuration. While the continuous structure does not provide a precise or exact division between the medial region and each arm, considering the body of the pillow in view of these components facilitates a description of the structure and function of the pillow.

Cantilever arms 18 and 20 include respective blunt ends 22 and 24, positioned remotely of the medial region. The support pillow is proportioned so that ends 22 and 24 normally (i.e. when not under external stress) touch one another, although they do not exert substantial pressure against each other. The toroidal shape defined by outer and inner curves 12 and 14 is proportioned such that at a central vertical plane, represented by the line 2—2 in FIG. 1, bisects pillow 10 and medial region 15. Pillow 10 thus has a bilateral symmetry with respect to the central plane. The central plane further contains a vertical, central axis about which the toroidal pillow body is formed. Profiles of the pillow taken radially of the central axis (i.e. sections of pillow 10 in planes that also contain the central axis) are elliptical in shape throughout the medial region, and likewise are elliptical throughout the length of each cantilever arm with the exception of blunt ends 22 and 24.

Well region 16 has a width W (FIG. 1) in the direction perpendicular to the central plane, of at least half the span across the width of an infant's torso, yet substantially less than such span, for example less than seven-eighths of this span. More particularly, a width W in the range of from about four to eight inches has been found satisfactory, while a particularly preferred width is six inches. The properly selected width ensures that cantilever arms 18 and 20 are far enough apart from one another to confine an infant over well region 16 against rolling in either direction away from the central plane. At the same time, arms 18 and 20 are sufficiently close that the infant is supported by these arms, rather than by the floor or other surface directly beneath pillow 10.

Figure 2:
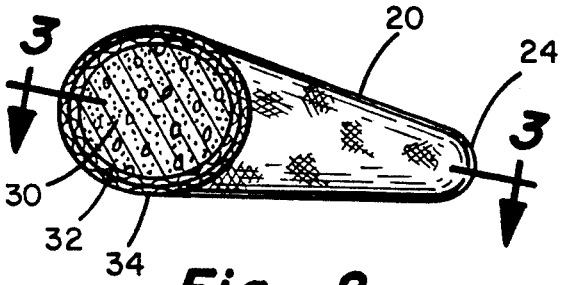
FIG. 2 is a side sectional view taken along the line 2—2 in FIG. 1.

With particular reference to FIG. 2, the composition of the preferred embodiment is shown. The central core 30 is a resilient, compression resistant, hypoallergenic material, such as polyester. It is encased in a lining 32, such as cotton or other pliant, conforming fabric. The polyester is firmly and tightly packed into lining 32, such that the core and lining together provide a self-supporting pillow body. The body of the support pillow is covered with a conforming, removable exterior covering 34, also preferably of cotton. The line 3—3 in FIG. 2 represents a horizontal mid-plane. The top and bottom halves of pillow 10 are symmetrical about the mid-plane. Accordingly, pillow 10 when inverted, still provides the desired support for infants. The elliptical profile shown in this figure, i.e. the profile in the central plane, preferably has a vertical height of about six inches and a circumference of about twenty-one inches, thus to approach a circular profile. Other profiles along either cantilever arm are likewise elliptical or essentially circular, although the profiles diminish in size as they approach the blunt ends of the cantilever arms.

Figure 3:
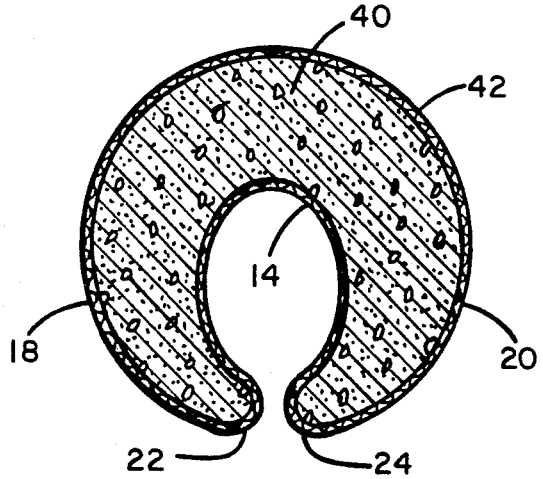
FIG. 3 is a sectional view taken along the line 3—3 in FIG. 2.

FIG. 3 depicts an alternative embodiment of the present invention. A resilient, unitary central core of a rubber or polymeric foam 40, such as polyethylene foam, forms the body of the support pillow. It is covered with a form-fitted but relatively loosely draped exterior covering 42, preferably of cotton fabric.

Various applications of the present invention are depicted in FIG. 4, views A–D. An infant may be comfortably placed on its stomach in line with the plane 2—2, as shown in FIG. 4A. In this position, the chest receives full support, as do the torso and legs, but the arms and head are free to move at will. This permits the infant to exercise and develop his musculature as he moves and plays with items placed in front of him. FIG. 4B depicts the converse. An infant is placed along the plane 2—2 with his back to the well region 16. In this position, the bones and musculature of the head and neck are fully supported, producing no strain. The infant's visibility can be enhanced by the position chosen. This aids in developing awareness of the surrounding environment. Furthermore, it provides a safe support because lateral movement is curtailed by gentle pressure from arms 22 and 24, and the sides serve as an arm rest. This firm, supportive position is advantageous in many settings. The infant can watch the occurrences in the room, play or be supported during feedings. The removable covering 34, 42 eliminates concern over messy feedings.

An important benefit of the present design is that in either position 4A or 4B, the infant cannot topple over. Furthermore, the rounded design prevents the infant from suffocation on, in or underneath the cushion.

The exact support points for an infant are determined by the baby's length and weight. As described for FIG. 4A, the chest of an infant in the range of 1–20 pounds can be propped on the back of the curve. In this position, the head and arms reach over the edge, but the chin remains supported on the pillow. This is advantageous, since infants of this size lack the neck strength and control to lift their heads adequately to look about. They have limited control when they use their arms and hands to prop themselves up, but then they cannot play. Use of the present invention provides sufficient support that hands are free to play with toys placed within reach. Alternatives, such as bed pillows, are not adequately supportive to permit this freedom of movement while holding the back and legs in a secure position, as when the body drapes over the back curve with the feet in the well region 16.

Figure 4A:
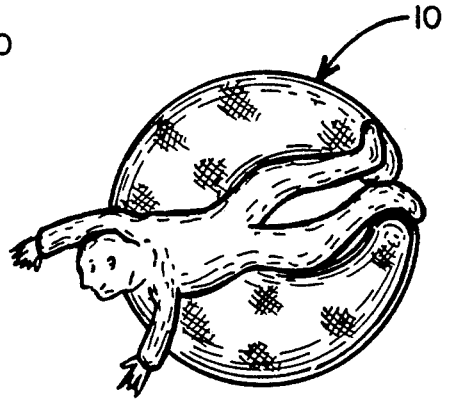
Figure 4B:
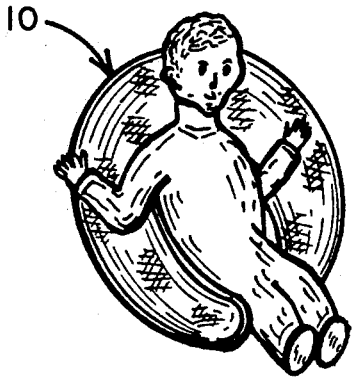
Figure 4C:
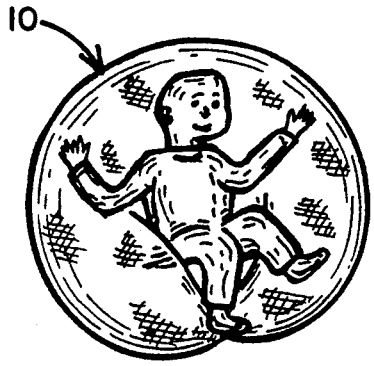

The range of 5–25 pounds permits alternative positions when the infant is placed on its back. When weighing in this range, the neck, head and shoulders are supported by the back of the curve, along the plane 2—2 (FIGS. 4B and 4C). Infants of a size 10–25 pounds have sufficient muscle control to be seated in the well region 16, with back against the back curve 2—2 and feet extending to or through the opening between the blunt ends 22, 24. Arms are supported by the sides 18, 20 of the cushion. This is advantageous since it permits the infant to sit up at an earlier age than they would otherwise, before they develop adequate strength to sit on their own. This is also advantageous since it aids in learning balance in a protective environment. When the infant loses her balance, she falls onto the soft cushion instead of a hard surface. An alternative position is possible for those in the range of 5–20 pounds. The infant may be placed on its back so that the bottom of the infant lies low in the well region 16, while the feet may be propped up on the blunt ends 22, 24 of the arms 18, 20 of the pillow. This is similar to the position that an adult attains when seated in a reclining chair.

Figure 4D:
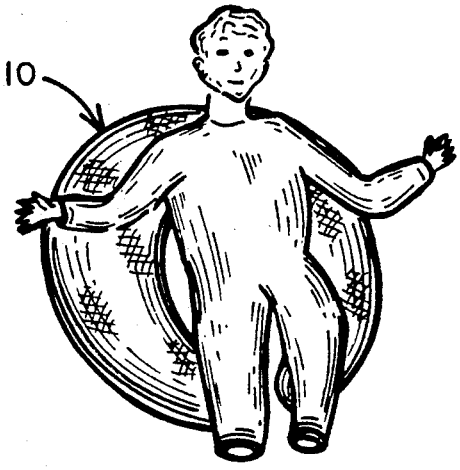
Figure 4E:
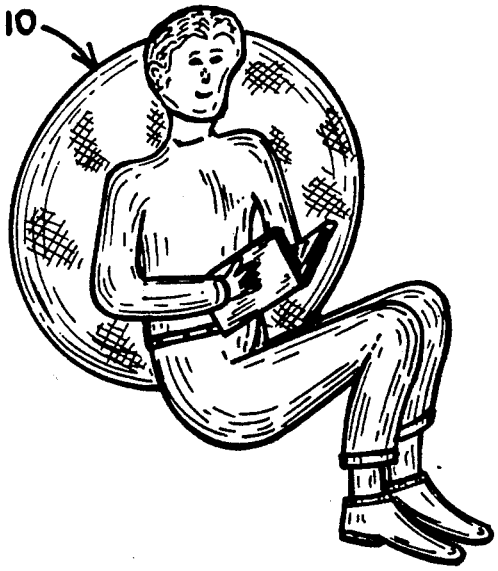

Children weighing in excess of 20 pounds are comfortable lying on the cushion when placed on the floor. Whether on their stomach or back, this affords limited visibility. A toddler is particularly comfortable leaning against the back along the plane 2—2, as shown in FIG. 4D. An older child is supported while watching TV or reading, as shown in FIG. 4E.

Thus, in accordance with the present invention, the entire body of an infant is supported in a manner that safely and comfortably confines the infant against sideways slipping or rolling, yet leaves the arms free for movement whether the infant is in a prone or a supine position. As a result, the infant is not subject to the risk of suffocation or injury involved with placing infants on the conventional bed pillows. Further, the infant can be maintained in positions favorable to playing, eating and other activities either requiring or enhanced by free movement of the arms, while avoiding undue strain to the muscles that support the neck and head.

What is claimed is:

1. A device for supporting infants, including:

a resilient cushion body having a medial region and first and second opposed cantilever arms extended in opposite directions from the medial region, said cantilever arms having respective first and second end portions remote from the medial region, said cusion body being firm in the sense of undergoing slight elastic deformation when subjected to the weight of the head and shoulders of an infant weighing in the range of from about five pounds to about twenty pounds, and further being self-supporting in the sense that when held by one hand along the medial region, the cushion body retains its shape without any sagging or drooping of the cantilever arms;

wherein the cantilever arms are curved about a vertical axis to determine a substantially toroidal configuration for the cushion body, and to position the first and second end portions in a confronting relation to one another, said arms and medial region cooperating to define a generally circular open well and substantially surrounding the well;

a nominal width of the well, taken perpendicular to a central plane that includes the vertical axis and passes through the medial region, being in the range of from about four to about eight inches; and wherein the first and second cantilever arms have respective first and second downwardly and radially inwardly inclined support surfaces along and adjacent the open well, the support surfaces contacting an infant when the cantilever arms and medial region support the infant substantially lengthwise along the central plane, with the head of the infant upon the medial region and the torso of the infant upon the cantilever arms and spanning the open well; the arms through their respective support surfaces thereby tending to confine the infant against rolling in either direction away from the central plane.

2. The device of claim 1 wherein:

said body has a vertical thickness that varies from a maximum thickness along the medial region and along the cantilever arms near the medial region, to a minimum thickness at each of the first and second end portions.

3. The device of claim 2 wherein:

said cushion body is symmetrical about the central plane.

4. The device of claim 3 wherein:

the cushion body further is symmetrical about a horizontal mid-plane.

5. The device of claim 1 wherein:

the first and second end portions are normally in surface contact with one another, and movable away from one another by elastic deformation of the cantilever arms.

6. The device of claim 1 wherein:

each of the arms and the medial region has a substantially elliptical profile, taken radially of the vertical axis.

7. The device of claim 1 further including:

an outer covering conforming to the shape of the cushion body and removably secured to the body.

8. The device of claim 7 wherein:

the cushion body and cover are constructed of hypoallergenic materials.

9. The device of claim 8 wherein:

the cushion body is constructed of a solid foam elastomer.

10. The device of claim 8 wherein:

the body is formed of a fabric outer lining forming an enclosure, and a polyester filling material contained within the enclosure.

11. A support pillow for infants, including:

a resilient cushion body having a medial region and first and second opposed cantilevered arms extended in opposite directions from the medial region, said cantilevered arms having respective first and second end portions remote from the medial region, said cushion body being firm in the sense of undergoing at most slight elastic deformation when subjected to the weight of the head and shoulders of an infant weighing in the range of from about five pounds to about twenty pounds, said cushion body further being self-supporting in the sense when held by one hand along the medial region, the cushion body retains its shape without any sagging or drooping of the cantilever arms;

wherein the cantilevered arms are curved about a vertical axis to determine a substantially toroidal configuration for the cushion body, and to position the first and second end portions in a confronting relation to one another, said arms and medial region cooperating to define a generally circular open well and substantially surrounding the well;

a nominal width of the well, taken perpendicular to a central plane that includes the vertical axis and passes through the medial region, being in the range of from about four to about eight inches; and wherein the first and second cantilever arms have respective first and second downwardly and radially inwardly inclined support surfaces along and adjacent the open well, the support surfaces contacting the infant when the cantilever arms and medial regions support the infant substantially lengthwise along the central plane, with the head of the infant upon the medial region and the torso of the infant upon the cantilever arms and spanning the open well; the arms through their respective support surfaces thereby tending to confine the infant against rolling in either direction away from the central plane and supporting the infant above a floor or other surface immediately beneath the cushion body.

12. The support pillow of claim 11 wherein:

said cushion body has a vertical thickness that varies from a maximum thickness along the medial region and along the cantilever arms near the medial region, to a minimum thickness at each of the first and second end portions.

13. The support pillow of claim 12 wherein:

said cushion body is symmetrical about the central plane.

14. The support pillow of claim 13 wherein:

the cushion body further is symmetrical about a horizontal mid-plane.

15. The support pillow of claim 11 wherein:

the first and second end portions are normally in surface contact with one another, and movable away from one another by elastic deformation of the cantilever arms.

16. The support pillow of claim 15 wherein:

each of the cantilever arms, and the medial region, have substantially elliptical profiles, as taken radially of the vertical axis.

* * * * *